US005398533A

United States Patent [19]

Shimanovski et al.

[11] Patent Number: 5,398,533

[45] Date of Patent: Mar. 21, 1995

[54] APPARATUS FOR PIERCING HYDROFORMED PART

[75] Inventors: Bruce S. Shimanovski, Southfield; George T. Winterhalter, Sr., Berkley; Sanjay M. Shah, Rochester Hills; Ranny J. Nunley, Berkley, all of Mich.

[73] Assignee: General Motors Corporation, Detroit, Mich.

[21] Appl. No.: 250,211

[22] Filed: May 26, 1994

[51] Int. Cl.[6] ..... B21D 28/28

[52] U.S. Cl. ..... 72/55; 72/56; 83/53; 29/421.1

[58] Field of Search ..... 72/55, 56; 83/53, 177, 83/22; 29/421.1

[56] References Cited

U.S. PATENT DOCUMENTS

| | | | |
|---|---|---|---|
| 3,310,972 | 3/1967 | Erlandson et al. | 72/55 |
| 3,487,668 | 1/1970 | Fuchs, Jr. | 72/55 |
| 3,495,486 | 2/1970 | Fuchs, Jr. | 83/53 |
| 3,714,807 | 2/1973 | Grunberger | 72/55 |
| 3,991,456 | 11/1976 | Lieser | 29/157.1 R |
| 4,989,482 | 2/1991 | Mason | 83/22 |

FOREIGN PATENT DOCUMENTS

| | | | |
|---|---|---|---|
| 484789 | 5/1992 | European Pat. Off. | 72/55 |
| 290627 | 11/1990 | Japan | 72/328 |
| 820976 | 4/1981 | U.S.S.R. | 72/55 |

*Primary Examiner*—David Jones
*Attorney, Agent, or Firm*—Patrick M. Griffin

[57] ABSTRACT

An apparatus for in-die piercing of a tube as it is hydroformed creates a sharp edged, non countersunk hole, while sealing against pressurized fluid loss and ejecting the slug cleanly from the apparatus. A sharp edged die button inset into one of a pair of die blocks includes a hole shaped cutting edge surrounded by a compliant face seal flush with the cavity between the die blocks. A plunger is slidable within a central bore in the die button from a closed position flush with the cutting edge to a partially retracted pierce position, and finally to a further retracted ejection position. An ejection chute in the same die block opens into the bore at one end, at a point between the pierce and ejection positions of the plunger, and also opens at the other end out of the die block. The plunger is sealed relative to the die button bore. The plunger is retained in closed position until the tube is fully hydroformed to final shape, and the outer surface of the tube engages the face seal. Then, the plunger is retracted to pierce position, allowing a slug to be blown out through the cutting edge. The face seal and plunger seal prevent the loss of fluid. Then, the tube is de pressurized, and the plunger retracts farther, allowing the slug to be ejected.

2 Claims, 3 Drawing Sheets

APPARATUS FOR PIERCING HYDROFORMED PART

This application relates to hydroforming apparatus in general, and specifically to a novel apparatus for piercing a hole in a hydroformed tube.

BACKGROUND OF THE INVENTION

Hydroforming is finding increasing use as a method for creating complex shapes from simple tubes, without separate cutting and welding steps. For example, a passenger car subframe may be made from a single tube, rather than multiple pieces. A simple tube blank of consistent cross section is placed between a pair of dies that close over the tube to create a sealed cavity. The cross section of the cavity matches the final part shape desired. The interior of the tube is sealed and highly pressurized with a fluid, such as water, so that its outer surface is forced to take on the shape of the cavity.

It is often necessary that the part have various holes and openings, for fasteners, location features, etc. It is possible to punch or drill these holes subsequent to the hydroforming operation, but it would be obviously desirable to do it simultaneously, in-die. The current state of the art is defined by U.S. Pat. No. 4,989,482 to Mason. As disclosed there, a punch 6 is pushed through a close fitting bore in one of the dies, toward the outer surface of the formed tube, while the tube is still highly internally pressurized. The punch 6 has a cupped, sharp edged end face 7 that pushes through the surface of the tube, shearing out a slug 13 and pushing it inside the tube, leaving a round hole 15 in the tube. The punch end face 7 is ported to atmosphere, and it is claimed that this creates a suction cup action that will keep the slug 13 adhered to it. Once the slug 13 is punched out, pressurized fluid from the tube interior is exposed to the sliding clearance between punch 6 and its bore, which can cause a potential leak out of the die cavity and pressure loss. Pressurized fluid is also exposed through hole 15 to the interface between the tube outer surface 1 and the contacting inner surface of die 3, which can potentially prevent the tube from expanding fully out into its desired final shape. Only the metal to metal contact of the end of the punch 6 sticking through and engaging the rough edged hole 15 would prevent these two potential leaks, and that is not a compliant or secure seal. Even that poor seal would be broken once the punch 6 was withdrawn. In fact, once the tube interior is pierced, a third potential leak path is created, past the slug 13 and through the ported punch face 7. Again, only the metal to metal seal of the adhered slug 13 to and against the punch face 7 would prevent such a leak, which is an unreliable seal at best. The patent does not explicitly mention such potential leaks. Nor does it deal with ejection of the slug 13, which would fall into the interior of the tube and would require a separate removal step once the formed tube was removed. This can be a very difficult operation with a complexly formed tube, and slugs can easily stick inside the wet tube.

The main concern of the Mason patent is not sealing or slug removal, but another inevitable problem with inwardly directed punching: so called countersinking. As the punch 6 is pushed through the tube wall, an annular area 14 of the tube surrounding the punched hole 15 is countersunk inwardly. Indeed, the slug 13 cannot be punched out otherwise. The patent claims that, since the slug 13 is adhered to the ported punch face 7, retracting the punch 6 will pull the adhered slug 13 back against or partially into the rough edge of the hole 15 that it left behind, sealing hole 15 enough that pressurized fluid can then push back and at least partially flatten the countersunk area 14. Again, reliance on a metal to metal seal, especially of rough, deformed edges against one another, is questionable. Even in the best case, the countersunk area is not completely flattened back out, nor is the edge of hole 15 sharp, nor is it claimed to be. Consequently, most pierced in the die holes in hydroformed parts will be found to have a very noticeable countersunk area, and the slug will be found to be hinged to one side of the hole, not completely sheared away.

The other possible method of in-die hole piercing is to allow the pressurized fluid to shear its own slug by blowing it outwardly, into a sharp edged cutting edge in the die. This leaves a sharp edged hole without countersinking, but presents its own problems in terms of timing, sealing, and slug ejection. If a hole is pierced too soon, pressurized fluid can leak into the tube die interface and prevent the tube from forming completely out into the die cavity, as noted. Once a hole has been pierced, it must be effectively sealed against the escape of pressurized fluid from inside the tube. And, the slug will be forced into the interior of the cutter, unless it is ejected back into the tube, and must be removed somehow as a later step. These problems unique to in-die piercing have not been adequately resolved to give a truly practical, production feasible system.

One fairly old reference, U.S. Pat. No. 3,495,486 to Fuchs, does disclose an apparatus that uses pressurized fluid to punch holes in a tubular member by blowing a portion of the tube through a sharp edged cutter. However, the tubular member disclosed is one that is already formed to shape, with a rectangular cross section, so the apparatus is really concerned only with hole forming per se, not tube forming. The problems unique to hydroforming at the same time as hole piercing, described above, are not faced or dealt with, and the apparatus shown could not be used practically in a hydroforming method. Fuchs shows two apparatuses, one in which the slug is blown outwardly, and one in which it is actually blown inwardly into a cutter, FIG. 9. In each case, the sharp edged cutter is provided in a structure separate from the main dies. In FIG. 8, where the slugs are blown outwardly, the cutters (118) are provided in a sleeve 114 that slides inside a cavity in a die block 111 and over the entire outer surface of the tube 110. In FIG. 9, where the slugs are blown inwardly, the cutters are provided in a mandrel 184 that fills the entire interior volume of the tube 110. The FIG. 9 apparatus, therefore, would be totally impossible to use in a hydroforming method, where the tube interior must be empty.

In the FIG. 8 apparatus, Fuchs does deal with the problem of controlling the timing of the slug blowout by providing a slidable back up plunger 138 within the cutter, which holds the tube surface back until sufficient piercing pressure is reached, then retracts it to allow slug blow out to occur. However, it must be kept in mind again that the pressurized fluid is needed only to blow out the slug, and not to hydroform the tube into its final shape as well. Therefore, the same sealing problems are not faced. There is no provision to keep pressurized fluid from leaking into the interface between the tube and surrounding sleeve. The only seal that is even an issue is the one needed, once the slug 156 is broken out, to keep pressurized fluid from escaping out of the tube interior and behind the plunger 138. Here again, as in the Mason patent, there is a hopeful reliance on the fact that the slug 156 will be tightly wedged into the cutter 118 to prevent leakage. While the slug 156 would indeed be tightly wedged and bowed inside the cutter 118, the metal to metal contact of the rough edged slug 156 against the inside of the cutter 118 would not provide a reliable seal, especially against very high pressure.

Another impediment to applying the Fuchs apparatus to in-die hole piercing is the problem of slug removal. Once the slug 156 is wedged tightly into the cutter 118, it will be difficult, if not impossible, to eject it by reversing the back up plunger 138, which is the ejection method described. Even if the slug 156 is successfully ejected, it will be pushed back inside the tube 110, or back into the sleeve 114, as the Fuchs patent claims. The sleeve 114 cannot be pulled without dismantling the whole apparatus, however, and having to remove a slug from inside a formed tube is not practical, as already noted. In short, nothing about the Fuchs apparatus, but for the broad idea of controlling the timing of the slug blow out with a back up plunger, can be practically applied to in-die hole piercing in the hydroforming context. A new apparatus dealing with those unique problems would be needed.

SUMMARY OF THE INVENTION

The invention provides an in-die piercing apparatus that punches sharp edged, undeformed holes in a hydroformed part, without jeopardizing the hydroforming process, and without significant fluid leakage. It also ejects the slug cleanly and easily from the tube and completely out of the die cavity, without having to remove the tube or open the dies. The disclosed apparatus is also well adapted to service and maintenance.

In the preferred embodiment disclosed, a basically conventional pair of hydroforming die blocks is closed to create a high pressure, sealed die cavity in the tube interior. At the point where the tube hole is desired, a removable, cylindrical die button is inset tightly into, and flush with, the surface of one die block. The die button has a sharp circular edge where the hole is to be punched through the tube, which is also surrounded by a compliant face seal. A cylindrical bore through the die button, just below the sharp cutting edge, is undercut to a diameter wider than the cutting edge. A back up plunger slides through the die button bore, moved by a controllable mechanical means, such as a cam. The forward end of the plunger is moved selectively from a closed position, flush with the cutting edge, to a pierce position, located below the edge. A compliant ring seal on the plunger, located just below the forward end, stays in tight sealing contact with the die button bore as the plunger moves. At a point below the plunger's pierce position, the die block is relieved by an ejection chute that opens, at one end, into the die button bore, and opens at the opposite end outside of the die block. The plunger can also be retracted farther to an ejection position where the forward end rests below the ejection chute.

In operation, the die blocks are closed around the tube, sealing its interior cavity. While the plunger is held in the closed position, the tube is internally pressurized to expand its outer surface forcefully into its final shape, and simultaneously against the die button face seal. Then, the plunger is retracted to the pierce position, allowing the pressurized fluid to blow a slug through and past the cutting edge and into the widened bore, where it rests freely, without binding. After the slug is pierced out, the face seal and ring seal cooperate to prevent fluid escape, either past tube surface or past the plunger. Finally, the tube is drained and de pressurized, but the die blocks can remain closed, and the formed tube stays in place. The slug is carried down into the ejection chute, where it can be kicked out of the die block by a suitable ejector mechanism. With wear, the die button and seals can be easily removed and replaced.

DESCRIPTION OF THE PREFERRED EMBODIMENT

These and other objects and features of the invention will appear from the following written description, and from the drawings, in which.

Figure 1:
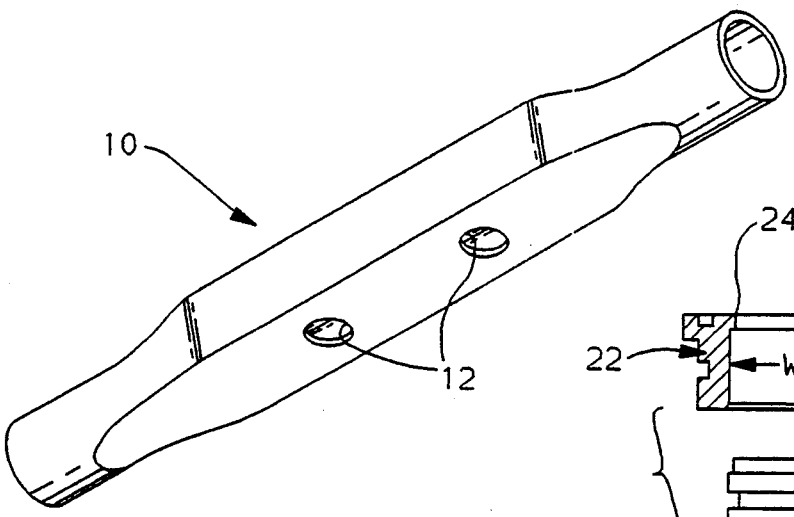
FIG. 1 is a perspective of a finished, pierced tube produced by the apparatus of the invention.

Referring first to FIG. 1, a fully hydroformed formed tube 10 has a pair of round holes 12 pierced therein, which are sharp edged and flat around the perimeter. The apparatus of the invention, described below, allows the holes 12 to be pierced simultaneously with the hydroforming process, and without interfering with or slowing that process in any significant way.

Figure 2:
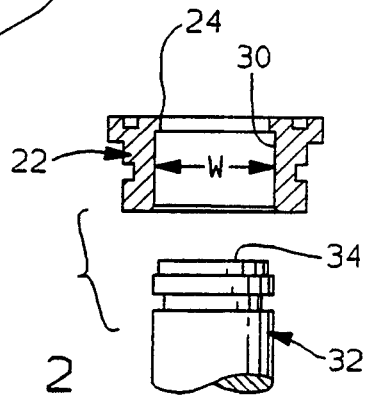
FIG. 2 is a view of a die button alone, showing the end of the plunger beneath.
Figure 3:
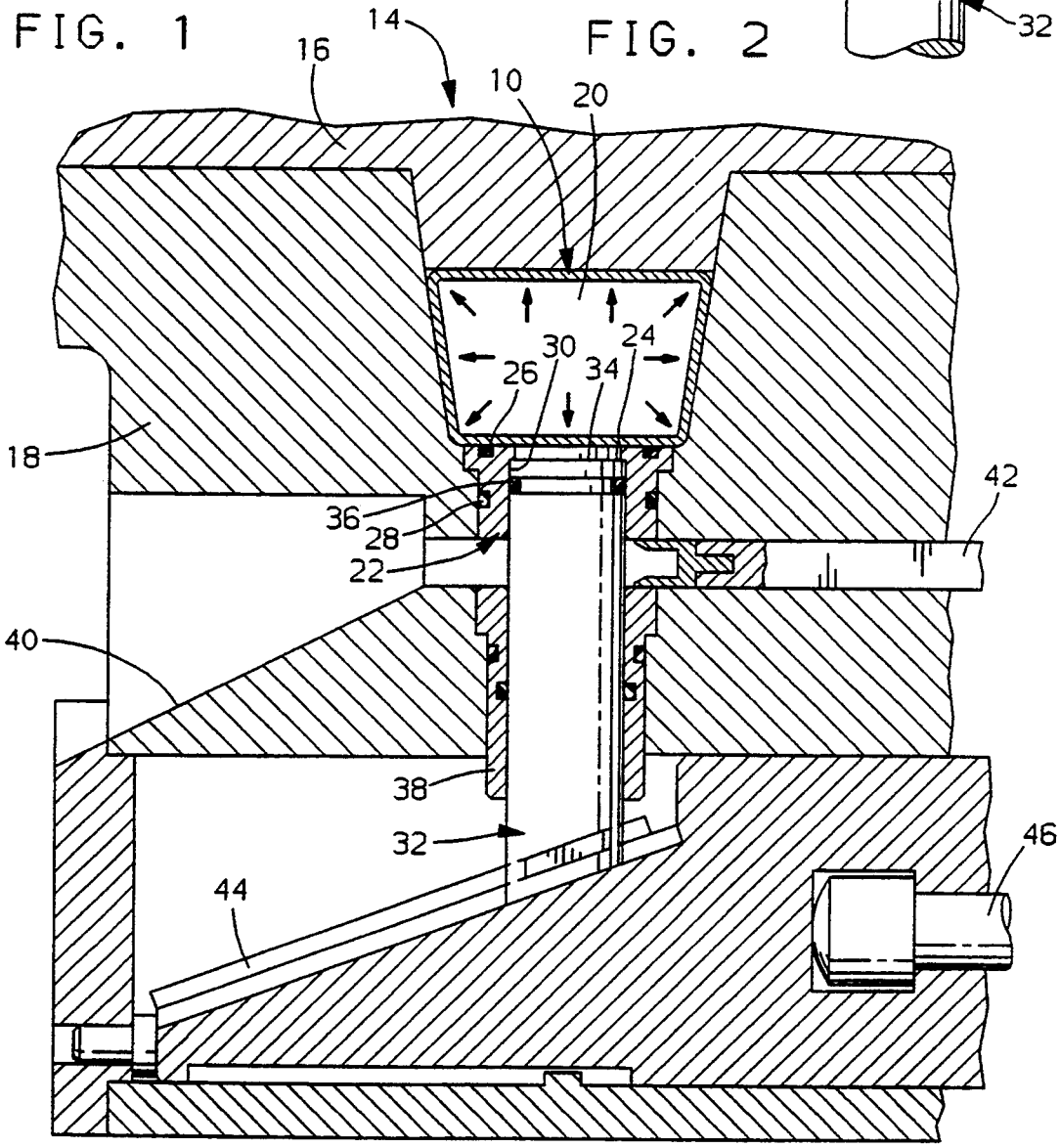
FIG. 3 is a cross section through a pair of closed die blocks, showing the plunger in closed position, and showing the tube pressurized just prior to piercing.
Figure 4:
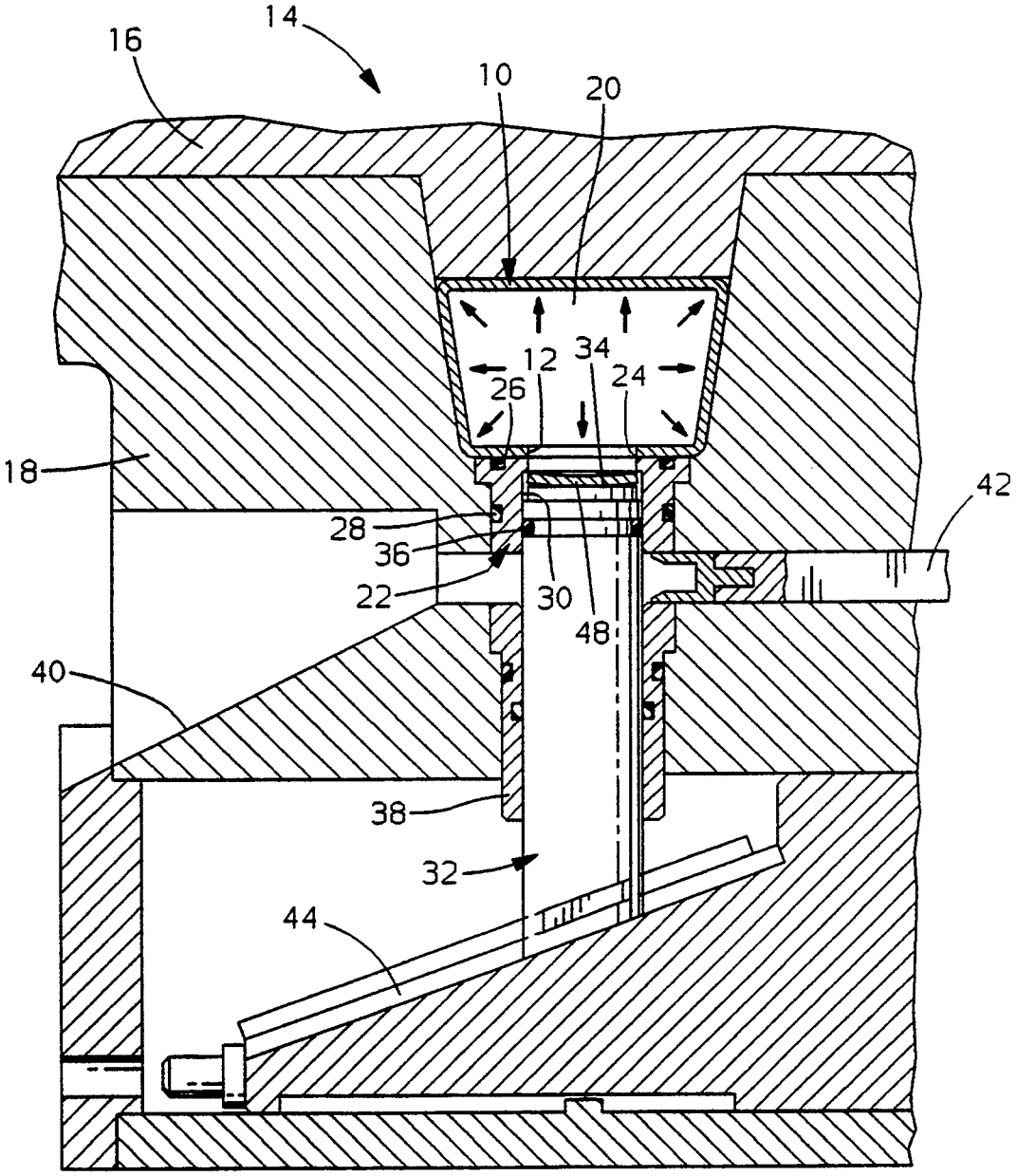
FIG. 4 is a view showing the plunger in the pierce position.

Referring next to FIGS. 2 and 3, the structural details of the apparatus of the invention, indicated generally at 14, will be described first, prior to detailing the operation thereof. A pair of die blocks, upper die block 16, and a lower die block 18, close together to create a sealed die cavity 20. FIG. 4 shows the tube 10 fully formed, so the interior of tube 10 and the die cavity 20 are, for all intents and purposes, one and the same volume. It should be understood that the terms "upper" and "lower" as applied to the die blocks and 18 are not limiting, as they could be reversed, or even side by side. Likewise as to terminology such as "above" and "below". Set into lower die block (or 16, or both) is a discrete, cylindrical die button, indicated generally at 22. Die button 22 is machined from die quality steel, and has a sharp circular cutting edge 24 which has a size and shape matching the perimeter of the desired hole 12. Edge 24 could be elliptical or any other shape. Edge 24 is surrounded by a compliant circular face seal 26, which, in a free state, is also substantially flush to cutting edge 24, but stands just slightly above the plane in which cutting edge 24 lies. Face seal 26 could be polyurethane or any other tough, compliant sealing material, and could be any shape, so long as it completely surrounded edge 24. The outer surface of die button 22 carries an O ring seal 28. The inner surface of die button 22 is undercut just below edge 24, and widened into a cylindrical bore 30 of width W, which will serve two functions described below. A cylindrical plunger, indicated generally at 32, has a forward end 34 that mates to the bore 30, flush to the cutting edge 24. Just below the forward end 34 is a ring seal 36, of similar material to face seal 26, with a free state diameter just slightly greater than W.

Referring next to FIG. 3, die button 22 is set into a matching cut out in die block 18, with its cutting edge 24 flush to the inner surface of cavity 20. Its ring seal 28 blocks its interface with die block 18, and its face seal 26 is presented to the cavity 20. The plunger forward end 34 sits flush with the cutting edge 24, at least initially, in what can be termed a closed position. The O ring seal 36 on plunger 32 is engaged with the bore 30 tightly enough to maintain a seal, but not so tightly as to prevent sliding movement therethrough. Below die button 22, lower die block 18 contains a sleeve 38 coaxial to die button bore 30, which also slidably engages plunger 32. Sleeve 38 could be just an integral bore in lower die block 18, but a sleeve 38 is conveniently replaceable with wear. Between the die button 22 and sleeve 38, an ejection chute 40 opens at a widened outer end outside of lower die block 18, and opens at an inner end just below die button bore 30 at what can be called an ejection point. Lower die block 18 also includes an ejection arm 42 which is designed to push partially through the ejection chute 40 and past bore 30, for a purpose described below. The lower end of plunger 32 is slidably keyed to a wedge shaped cam 44, which is moved back and forth by a hydraulic cylinder or the equivalent, the end of which is shown at 46. Sliding cam 44 back and forth in turn retracts and extends plunger 32, in a manner described next.

Referring still to FIG. 3, the first step in the operation of apparatus 14 is illustrated. A tube blank, not illustrated in its initial, unformed state, is placed between the die blocks 16 and 18, which are then clamped shut and sealed. The tube blank would initially have a uniform round or square cross section. The tube blank is then highly internally pressurized to a sufficient pressure, which can be called the forming pressure, to expand its outer surface out into the final shape shown. Pressure is indicated by the outwardly directed arrows. It will be appreciated by those skilled in the art that prior testing must be done to empirically determine the forming pressure for each case. While it is not possible to see the tube 10, the pressure can monitored and measured, so it will be known when tube 10 has fully expanded. In turn, all the movable parts of apparatus 14, such as cam 44, can be controlled based on the monitored pressure, either manually, or automatically, in conjunction with a standard computer controller and limit switches. As tube 10 expands to final form, its outer surface is forced tightly into the rim of die button 22, but the flush plunger forward end 34 supports it and prevents contact with the cutting edge 24. Cam 44 is held rigidly in the position shown, so plunger forward end 34 does not move from its flush condition. Because cam 44 is a mechanical mechanism entirely separate from lower die block 18, it can be very accurately and reliably controlled, and is not potentially affected by leakage out of cavity 20, even if fluid did escape past ring seal 36. The outer surface of tube 10 is also forced tightly into the compliant face seal 26. Therefore, up to the point in the process shown in FIG. 3, the forming process has occurred just as it would in a conventional hydroforming process, and the surface of tube 10 remains un deformed and unbroken.

Referring next to FIG. 4, the next basic step in the operation is illustrated. If the plunger forward end 34 is retracted out of its flush position far enough, and if the pressure has in cavity 20 has reached what may be termed a pierce pressure, then the now unsupported tube surface area enclosed by cutting edge 24 can be blown out, creating a slug 48 and leaving hole 12 behind. Face seal 26 prevents the escape of pressurized fluid between the outer surface of tube 10 and the die blocks 16 and 18. To retract plunder 24, cam 44 is pulled to the right by hydraulic cylinder 46. In the embodiment shown, forward end 34 is actually retracted slightly farther than is necessary just to pierce slug 48, and far enough to let slug 48 move past the edge 24 and into the wider, undercut bore 30, where its edge will not be in contact with the inside of button 22. It will be noted however, that the plunger ring seal 36 stays engaged with the die button bore 30, preventing the escape of fluid past it. If the plunger forward end 34 were retracted less, then the edge of slug 48 could be engaged just below the cutting edge 24. As noted above, however, metal to metal contact is unreliable as a seal, and certainly will not provide a seal sufficient to keep pressurized fluid out of bore 30. However, the ring seal 36 does prevent the escape of more fluid from cavity 20 than will fill the residual volume of die button bore 30 not filled by plunger 32. This is not a large volume, especially in relation to the total volume of cavity 20, and is not likely to reduce the pressure in cavity 20 significantly. If a large number of holes like 12 were to be pierced, the sequence could be programmed to retract the cams 44 one at a time, and even to re extend the plungers 32 to help re pressurize cavity 20 to aid in the piercing of subsequent holes 12.

Exactly what the pierce pressure will be for any particular tube 10 must be determined empirically for each case. So, too, the distance to which plunger forward end 34 would have to be retracted to allow the pierce pressure to work. Both quantities will be a function of tube wall material and thickness, desired size and shape of hole 12, etc. No hard and fast formula can be given. The pierce pressure may be more, or less, than the forming pressure. If it is less, then the support from the plunger forward end 34 will prevent premature piercing, assuring that tube 10 will be fully formed, and that face seal 26 will consequently be securely engaged to prevent pressurized fluid from escaping around the outer surface of tube 10. If the pierce pressure is greater than the forming pressure, then the cavity 20 would have to be pressurized farther, up to the piercing pressure, which would, of course, not interfere with the forming of tube 10 or with the engagement of face seal 26. To recap, the apparatus 14 deals successfully with two of the three practical problems with in-die piercing noted above, pierce timing and sealing.

Figure 5:
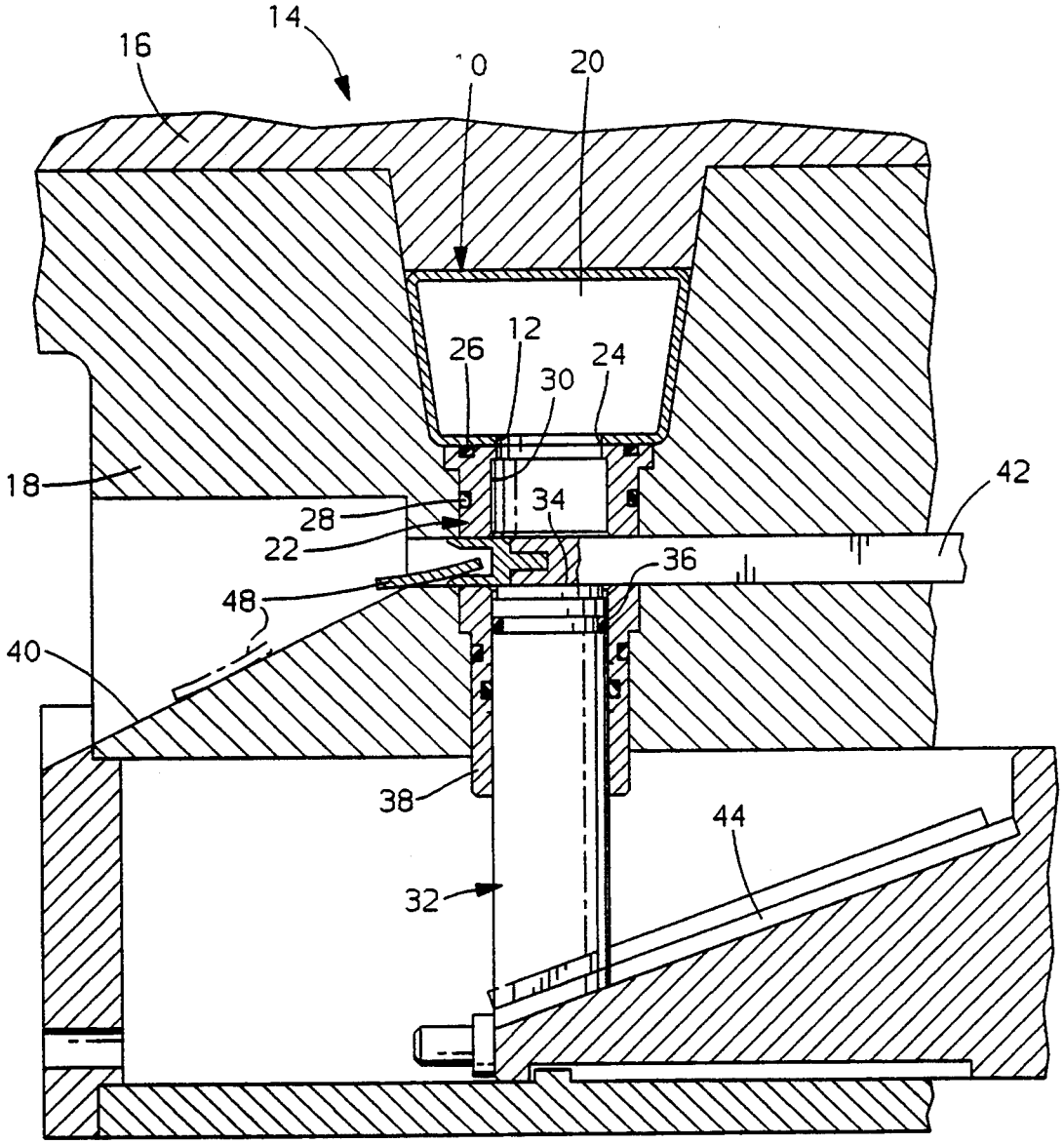
FIG. 5 is a view showing the plunger in the ejection position, with the slug being ejected.

Referring finally to FIG. 5, it may be seen how the invention also deals with the third problem noted above, slug ejection. First of all, the ejection of slug 48 is aided by the very nature of the improved piercing process allowed by apparatus 14. Since there is no reliance on using the slug 48 as any kind of seal, as in the prior art processes described above, it need not be jammed into bore 30, or forced to retract back into sealing contact with its pierced hole. In addition, as noted above, with sufficient retraction of plunger forward end 34, slug 48 can move down into the wider undercut portion of bore 30, completely freely, while cavity 20 still remains sealed by seal 36. Then, cavity 20 can be de pressurized, signalled by the fact of all the cams 44 having reached pierce position, which can be easily monitored with limit switches and the like. Cavity 20 has to be de pressurized in any hydroforming process at some point, anyway, so this represents no additional step or cost. Then, cam 44 may be pulled farther to the right, retracting plunger forward end 34 even farther, down into the coaxial sleeve 38 and below chute 40, which may be referred to as an ejection position. While the ring seal 36 disengages, it is not needed at this point. The unjammed slug 48 falls freely down into one end of the chute 40. At this point, the ejection arm 42 is pushed to the left, sweeping the slug 48 easily out of chute 40. Then, arm 42 is retracted, and plunger 32 re extended to repeat the cycle, which can be done very quickly. The time necessary to eject slug 48 is far less than what would be required to shake it out of the interior of the formed tube 10, or to remove a separate, slug holding structure from between the die blocks 16 and 18. Thus, apparatus 14 makes indie hole piercing truly practical in terms of pierce timing and control, fluid sealing, and slug removal.

Variations in the apparatus 14 disclosed could be made. Die button 22 could be in the upper die block 16, on the side, or anywhere a hole 12 was needed. Therefore, as already noted, terms such as "up", "down" and "below" are exemplary only. If bore 30 were directly into a die block, with its upper edge doing the cutting, die button 22 could be eliminated as a separate part, as could the seal 28. However, it adds no appreciable cost to add the separable die button 22, and it is probably even easier to machine it as a separate pan, allowing it to be of a customized material. More important, it also allows easy replacement of the cutting edge 24 and face seal 26 with wear. Any mechanism like cam 44 that allowed plunger 32 to be reliably and accurately retracted, such as a rotary cam or a screw mechanism, could be used. A hydraulic piston internal and integral to the lower die block 18 would not be preferred as a means to move plunger 32, however, because of potential leakage problems. Another slug ejection mechanism other than arm 42 could be used, such as a blast of compressed air. Therefore, it will be understood that it is not intended to limit the invention to just the embodiment disclosed.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege are claimed are defined as follows:

1. An apparatus for hydroforming a tube and simultaneously piercing a hole therethrough, comprising, a pair of die blocks that can be closed to form a sealed die cavity, one of said die blocks also having a plunger bore that opens into said cavity across a sharp cutting edge flush with the surface of said die block and matching the desired hole shape to be pierced, said die block further having a compliant face seal surrounding and substantially flush with said cutting edge, said die block also having an ejection chute that opens at one end into said plunger bore at an ejection point below said cutting edge and which opens at the other end outside of said die block, a plunger slidable within said bore with a forward end that mates flush with said cutting edge in a closed position and having a compliant ring seal that engages said bore, means for selectively retracting said plunger forward end from said closed position, to an intermediate position between said cutting edge and said ejection point, and then to an ejection position located below said ejection point, whereby, said tube may be placed in said die cavity, while said plunger forward end is closed and said tube is pressurized internally until sufficient pressure is attained to expand said tube into said cavity and engage its outer surface with said face seal, after which said plunger forward end is retracted to its intermediate position to allow a slug to be pierced through said cutting edge and against said plunger forward end, after which said tube is depressurized and said plunger forward end is retracted farther to its ejection position to carry said slug to said ejection point to allow it to be ejected through said ejection chute while said die blocks remain closed.

2. An apparatus for hydroforming a tube and simultaneously piercing a hole therethrough, comprising, a pair of die blocks that can be closed to form a sealed die cavity, a separable, replaceable die button located in one die block having a cutting edge flush with said die block and matching the desired hole shape to be pierced, said die button further having a compliant face seal surrounding said cutting edge, said die button also having a plunger bore that opens into said cavity across said cutting edge, said die block further having an ejection chum that opens at one end at an ejection point into said die button bore and which opens at the other end outside of said die block, a plunger slidable within said die block and having a forward end slidable with said die button bore that mates flush with said cutting edge in a closed position and having a compliant ring seal that engages said bore, means for selectively retracting said plunger forward end from said closed position, to an intermediate position between said cutting edge and said ejection point, and then to an ejection position located below said ejection point, whereby, said tube may be placed in said die cavity, while said plunger forward end is closed and said tube is pressurized internally until sufficient pressure is attained to expand said tube into said cavity and engage its outer surface with said face seal, after which said plunger forward end is retracted to its intermediate position to allow a slug to be pierced through said die button cutting edge and against said plunger forward end, after which said tube is de pressurized and said plunger forward end is retracted farther to its ejection position to carry said slug to said ejection point to allow it to be ejected through said ejection chute while said die blocks remain closed, and whereby said die button and face seal may be removed and replaced with wear.

* * * * *